US005240805A

United States Patent [19]

Asada et al.

[11] Patent Number: 5,240,805

[45] Date of Patent: Aug. 31, 1993

[54] ELECTROPHOTOGRAPHIC TONER

[75] Inventors: Hidenori Asada, Hirakata; Shigeki Yamada, Nara; Takeshi Arakawa, Osaka; Hiroshi Komata, Amagasaki; Nobuyuki Tsuji, Kakogawa, all of Japan

[73] Assignee: Mita Industrial Co., Ltd., Osaka, Japan

[21] Appl. No.: 734,454

[22] Filed: Jul. 23, 1991

[30] Foreign Application Priority Data

Jul. 25, 1990 [JP] Japan ..... 2-197370

[51] Int. Cl.[5] ..... G03G 9/087

[52] U.S. Cl. ..... 430/109; 430/904

[58] Field of Search ..... 430/109, 404, 106, 106.6, 430/110

[56] References Cited

U.S. PATENT DOCUMENTS 4,499,168 2/1985 Mitsuhashi ..... 430/99
4,966,829 10/1990 Yasuda et al. ..... 430/109
5,077,168 12/1991 Ogami et al. ..... 430/109

FOREIGN PATENT DOCUMENTS

0332212A3 9/1989 European Pat. Off. .
60-255668 12/1985 Japan .
62-115170 5/1987 Japan .
2091435 7/1982 United Kingdom .

*Primary Examiner*—Marion E. McCamish
*Assistant Examiner*—Rosemary Ashton
*Attorney, Agent, or Firm*—Beveridge, DeGrandi, Weilacher & Young

[57] ABSTRACT

The present invention provides an electrophotographic toner containing, as a fixing resin, a styrene-acrylic copolymer in which styrene content and molecular-weight distribution are specified, and which contains a specific high-molecular-weight component.

The electrophotographic toner of the present invention is improved in bending resistance while assuring excellent low-temperature fixing properties, resistance to off-set and heat resistance.

4 Claims, 1 Drawing Sheet

ELECTROPHOTOGRAPHIC TONER

BACKGROUND OF THE INVENTION

The present invention relates to an electrophotographic toner and more particularly to an electrophotographic toner to be used for an image forming apparatus such as an electrostatic copying apparatus, a laser beam printer or the like.

In the image forming apparatus above-mentioned, a developer containing an electrophotographic toner is first held around the outer periphery of a developing sleeve incorporating magnetic polarities, thereby to form a so-called magnetic brush. Then, the magnetic brush is let to come in contact with a photoreceptor on the surface of which an electrostatic latent image is being formed, so that the electrophotographic toner is electrostatically sticked to the electrostatic latent image. This causes the electrostatic latent image to be turned into a toner image. Then, the toner image is transferred to paper from the surface of the photoreceptor and fixed on the paper by fixing rollers. Thus, an image corresponding to the electrostatic latent image is formed on the paper.

As the electrophotographic toner, there may be used an electrophotographic toner as obtained by blending a fixing resin with a coloring agent such as carbon black, a charge controlling agent and the like and by pulverizing the blended body into particles having sizes in a predetermined range.

The electrophotographic toner above-mentioned may present the problem of so-called off-set such as contamination of paper at the reverse side thereof or contamination of the fixing rollers due to toner falling from the paper. In particular, when the fixing temperature is low, the toner image might not be satisfactorily fixed onto the paper (deterioration of fixing properties at a low temperature).

Of the problems above-mentioned, the deterioration of fixing properties at a low temperature occurs mainly when the molecular weight of the fixing resin contained in the electrophotographic toner is high. On the other hand, the off-set occurs mainly when the molecular weight of the fixing resin is low.

To overcome the problems above-mentioned, there have been proposed various examples of the electrophotographic toner jointly containing resin having low molecular weight and resin having high molecular weight (See, for example, Japanese Patent Unexamined Publications No. 16144/1981 and No. 3644/1985).

A conventional electrophotographic toner is not provided with sufficient heat resistance. Accordingly, when the conventional electrophotographic toner is used for a low-speed image forming apparatus in which temperature is raised to a high temperature, the toner is blocked to provoke toner blanking, a so-called rainfall phenomenon, defective cleaning and the like. The toner blanking refers to the phenomenon that giant toner particles produced as agglomerated due to blocking are caught in the space between the photoreceptor and paper to form gaps therearound, thus preventing the toner from being transferred to the paper, thereby to leave white portions on the resulting image. The "rainfall" refers to the phenomenon that toner molten and sticked to the surface of the photoreceptor drum due to blocking leave traces in the form of stripes on the resulting image. The defective cleaning refers to the phenomenon that blocked toner is sticked to the blade for cleaning the photoreceptor drum. Such defective cleaning may cause the toner blanking or "rain-fall" above-mentioned.

Further, the conventional electrophotographic toner is, after fixed, liable to be separated from paper when the paper is bent or folded, and is therefore disadvantageous in bending resistance.

SUMMARY OF THE INVENTION

It is a main object of the present invention to provide an electrophotographic toner excellent in fixing properties at a low temperature, resistance to off-set and heat resistance, as well as bending resistance.

To achieve the object above-mentioned, the inventors of the present invention have studied the relationship between the physical properties of a styrene-acrylic copolymer serving as a fixing resin and the heat resistance and bending resistance of the electrophotographic toner. As a result, the inventors have found that the toner could be improved in heat resistance when the styrene content in the styrene-acrylic copolymer was increased to raise the glass transition temperature of the fixing resin. The inventors have also found that the toner could be improved in bending resistance when the fixing resin contained a high-molecular-weight component of which molecular weight exceeded $2.1\times10^5$. The reason of why the toner is improved in bending resistance by the presence of such a high-molecular-weight component, is considered to be as set forth below. That is, the main chain of the high-molecular-weight component is liable to be cut by heat or mechanical shear force. Accordingly, when the fixing resin is thermally kneaded at the time of toner production, the main chain of the high-molecular-weight component is cut, causing the component to become a number of polymers having a small molecular weight. This increases the terminal functional group in amount, thereby to improve the fixing resin in adhesion with paper. As the molecular weight is lowered, the fixing resin is improved in flexibility. This improves the fixing resin in paper-following properties. Together with the improvement in paper-adhesion properties, such improvement in paper-following properties causes the resultant toner to be improved in bending resistance.

In order that the styrene-acrylic copolymer contains the high-molecular-weight component above-mentioned and also contains styrene in a high content without injuring the low-temperature fixing properties and resistance to off-set, the inventors have continuously studied the styrene-acrylic copolymer with the determination of the molecular-weight distribution thereof taken into consideration.

According to the present invention, there is provided an electrophotographic toner which contains, as the fixing resin, a styrene-acrylic copolymer containing styrene in an amount of not less than 80% by weight with respect to the entire resin amount and presenting a gel permeation chromatogram of molecular-weight distribution in which the maximum value is located in each of ranges from not less than $1\times10^3$ to less than $1\times10^5$ and from not less than $1\times10^5$ to not greater than $3\times10^5$, and in which a component with a molecular weight exceeding $2.1\times10^5$ is present in a range from 0.5 to 20% by weight with respect to the entire resin amount.

DETAILED DESCRIPTION OF THE INVENTION

According to the present invention, the content of styrene in the entire resin is limited to not less than 80% by weight. This is because, if such a content is less than 80% by weight, the glass transition temperature of the fixing resin is not sufficiently increased, thus failing to improve the toner in heat resistance.

The content of the high-molecular-weight component of which molecular weight exceeds $2.1\times10^5$, is limited to the range from 0.5 to 20% by weight with respect to the entire resin amount, for the reason set forth below. That is, if this content is less than 0.5% by weight, the toner cannot be improved in bending resistance due to the mechanism above-mentioned. On the other hand, if this content exceeds 20% by weight, a great amount of a component having a relatively small molecular weight is produced at the time of thermal kneading of the fixing resin, thus lowering the fixing resin in glass transition temperature to deteriorate the heat resistance.

Figure 1:
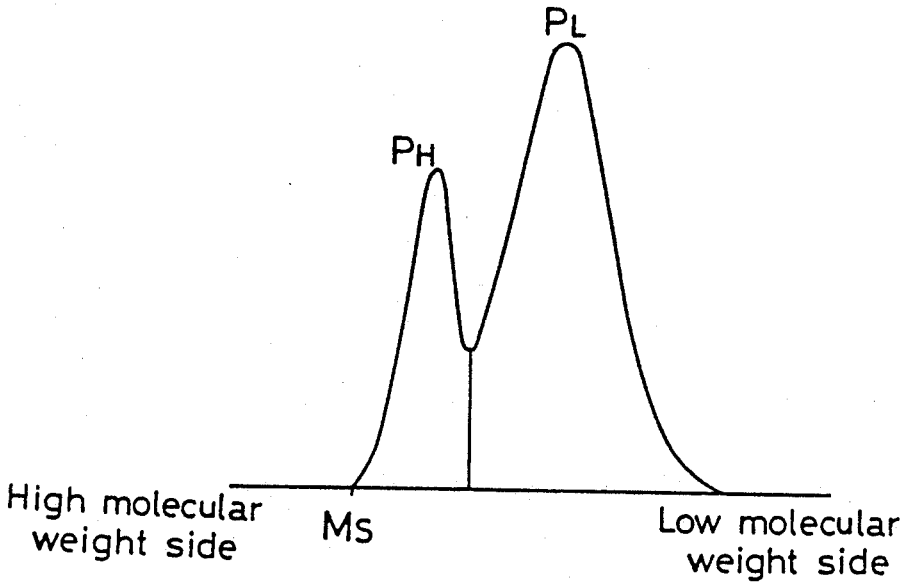
FIG. 1 is a gel permeation chromatogram showing an example of the molecular-weight distribution of a styrene-acrylic copolymer.

There may be used, as the styrene-acrylic copolymer serving as a toner fixing resin, a copolymer presenting a gel permeation chromatogram of molecular-weight distribution as shown in FIG. 1 in which maximum values $P_H$ and $P_L$ are respectively located in the high-molecular-weight side and the low-molecularweight side. Another maximum value may be further located between both maximum values $P_H$ and $P_L$.

According to the present invention, the molecular weight of the maximum value $P_H$ at the high-molecular-weight side is limited to a range from not less than $1\times10^5$ to not greater than $3\times10^5$. If the molecular weight of the maximum value $P_H$ is less than $1\times10^5$, the high-molecular-weight component in the styrene-acrylic copolymer is insufficient in amount, thus failing to produce a toner excellent in resistance to off-set. On the other hand, if the molecular weight of the maximum value $P_H$ exceeds $3\times10^5$, this results in the presence of a great amount of the high-molecularweight component which is liable to be cut upon reception of heat or mechanical shear force. Therefore, the heat resistance is rather deteriorated. Preferably, the molecular weight of the maximum value $P_H$ at the high-molecular-weight component side is in a range from $1.5\times10^5$ to $2.5\times10^5$.

According to the present invention, the molecular weight of the maximum value $P_L$ at the low-molecular-weight side is limited to a range from not less $1\times10^3$ to less than $1\times10^5$. If the molecular weight of the maximum value P is not less than $1\times10^5$, the amount of the low-molecular-weight component in the styrene-acrylic copolymer is too insufficient to obtain a toner excellent in fixing properties at a low temperature. On the other hand, if the molecular weight of the maximum value P is less than $1\times10^3$, the shape retention of the styrene-acrylic copolymer is too insufficient to obtain a toner excellent in durability. Preferably, the molecular weight of the maximum value $P_L$ at the low-molecular-weight side is in a range from $2\times10^3$ to $1\times10^4$.

The styrene-acrylic copolymer may be produced either by uniformly melting and blending a plurality of types of styrene-acrylic copolymers having different molecular-weight distributions or by using a two-stage polymerization, such that the resultant styrene-acrylic copolymer has the molecular-weight distribution above-mentioned.

Figure 2:
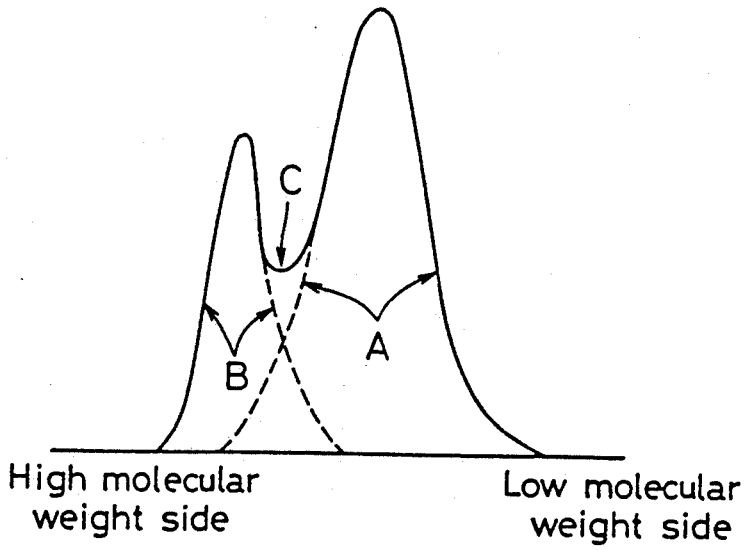
FIG. 2 is a gel permeation chromatogram showing an example of a method of obtaining a styrene-acrylic copolymer presenting the molecular-weight distribution shown in FIG. 1.

For example, as shown in FIG. 2, when there are molten and blended, in the same amount, a styrene-acrylic copolymer (low-molecular-weight component) having a molecular-weight distribution shown by a curve A and a styrene-acrylic copolymer (high-molecular-weight component) having a molecular-weight distribution shown by a curve B, there is obtained a styrene-acrylic copolymer having a molecular-weight distribution as shown by a curve C.

According to a suspension polymerization or an emulsion polymerization, a polymer having a high molecular weight may be generally more easily produced as compared with a solution polymerization. Accordingly, the styrene-acrylic copolymer having the molecularweight distribution above-mentioned may be produced by a multi-stage polymerization in which the suspension polymerization or the emulsion polymerization and the solution polymerization are combined in this order or in the reverse order with the molecular weight adjusted at each stage. The molecular weight or molecular-weight distribution may be adjusted by suitably selecting the type or amount of an initiator, the type of a solvent, a dispersing agent or an emulsifying agent relating to chain transfer, and the like.

As a styrene monomer, there may be used vinyltoluene, α-methylstyrene or the like, besides styrene. As an acrylic monomer, there may be used a monomer represented by the following general formula (I):

$$CH_2{=}\overset{\overset{\displaystyle R^1}{|}}{C}{-}CO{-}O{-}R^2 \qquad (I)$$

wherein $R^1$ is a hydrogen atom or a lower alkyl group, $R^2$ is a hydrogen atom, a hydrocarbon group having 1 to 12 carbon atoms, a hydroxyalkyl group, a vinylester group or an aminoalkyl group.

Examples of the acrylic monomer represented by the general formula (I), include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacracrylate, ethyl β-hydroxymethacrylate, propyl γ-aminoacrylate, propyl γ-N,N-diethylaminoacrylate, ethylenelycol glycol dimethacrylate, tetraethylene glycol dimethacrylate and the like.

The most suitable styrene-acrylic copolymer is a styrene/butyl acrylate copolymer.

The toner may be produced by blending the fixing resin above-mentioned with additives such as a coloring agent, a charge controlling agent, a release agent (offset preventing agent) and the like, and by pulverizing the blended body into particles having suitable particle sizes.

Examples of the coloring agent include a variety of a coloring pigment, an extender pigment, a conductive pigment, a magnetic pigment, a photoconductive pigment and the like. The coloring agent may be used alone or in combination of plural types according to the application.

The following examples of the coloring pigment may be suitably used.

Black

Carbon black such as furnace black, channel black, thermal, gas black, oil black, acetylene black and the like, Lamp black, Aniline black White Zinc white, Titanium oxide, Antimony white, Zinc sulfide Red Red iron oxide, Cadmium red, Red lead, Mercury cadmium sulfide, Permanent red 4R, Lithol red, Pyrazo.lone red, Watching red calcium salt, Lake red D, Brilliant carmine 6B, Eosine lake, Rhodamine lake B, Alizarine lake, Brilliant carmine 3B Orange Chrome orange, Molybdenum orange, Permanent orange GTR, Pyrazolone orange, Vulcan orange, Indanthrene brilliant orange RK, Benzidine orange G, Indanthrene brilliant orange GK Yellow Chrome yellow, Zinc yellow, Cadmium yellow, Yellow iron oxide, Mineral fast yellow, Nickel titanium yellow, Naples yellow, Naphthol yellow S, Hansa yellow 10G, Benzidine yellow G, Benzidine yellow GR, Quinoline yellow lake, Permanent yellow NCG, Tartrazine lake Green Chrome green, Chromium oxide, Pigment green B, Malachite green lake, Fanal yellow green G Blue Prussian blue, Cobalt blue, Alkali blue lake, Victoria blue lake, Partially chlorinated phthalocyanine blue, Fast sky blue, Indanthrene blue BC Violet Manganese violet, Fast violet B, Methyl violet lake Examples of the extender pigment include Baryte powder, barium carbonate, clay, silica, white carbon, talc, alumina white.

Examples of the conductive pigment include conductive carbon black, aluminium powder and the like.

Examples of the magnetic pigment include a variety of ferrites such as triiron tetroxide ($Fe_3O_4$), iron sesquioxide ( $\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

The coloring agent may be contained in an amount from 1 to 30 parts by weight and preferably from 2 to 20 parts by weight for 100 parts by weight of the fixing resin.

As the electric charge controlling agent, there may be used either one of two different electric charge controlling agents of the positive charge controlling type and the negative charge controlling type, according to the toner polarity.

As the electric charge controlling agent of the positive charge controlling type, there may be used an organic compound having a basic nitrogen atom such as a basic dye, aminopyrine, a pyrimidine compound, a polynuclear polyamino compound, aminosilane, a filler of which surface is treated with any of the substances above-mentioned.

As the electric charge controlling agent of the negative charge controlling type, there may be used a compound containing a carboxy group (such as metallic chelate alkyl salicylate or the like), a metal complex salt dye, fatty acid soap, metal salt naphthenate or the like.

The electric charge controlling agent may be preferably used in a range from 0.1 to 10 parts by weight and more preferably from 0.5 to 8 parts by weight for 100 parts by weight of the fixing resin.

Examples of the release agent (off-set preventing agent) include aliphatic hydrocarbon, aliphatic metal salts, higher fatty acids, fatty esters, its partially saponified substances, silicone oil, waxes and the like. Of these, there is preferably used aliphatic hydrocarbon of which weight-average molecular weight is from 1,000 to 10,000. More specifically, there is suitably used one or a combination of plural types of low-molecular-weight polypropylene, low-molecular-weight polyethylene, paraffin wax, a low-molecular-weight olefin polymer composed of an olefin monomer having 4 or more carbon atoms and the like.

The release agent may be used in an amount from 0.1 to 10 parts by weight and preferably from 0.5 to 8 parts by weight for 100 parts by weight of the fixing resin.

The toner is produced by a method of previously mixing the components above-mentioned uniformly with the use of a dry blender, a Henschel mixer, a ball mill or the like, uniformly melting and kneading the resultant mixture with the use of a kneading device such as a Banbury mixer, a roll, a single- or double-shaft extruding kneader or the like, cooling and grinding the resultant kneaded body, and classifying the resultant ground pieces as necessary. The toner may also be produced by suspension polymerization or the like.

The toner particle size is preferably from 3 to 35 $\mu$m and more preferably from 5 to 25 $\mu$m.

To improve the flowability and electric charging characteristics, the toner may be covered at the surface thereof with any of conventional surface treating agents such as inorganic fine particles, fluoroplastic particles and the like. Preferably, there may be used a silica-type surface treating agent containing hydrophilic or hydrophobic silica fine particles such as silica anhydride in the form of microfine particles, coloidal silica or the like.

The toner as mixed with a magnetic carrier such as ferrite, iron powder or the like may be used as a two-component developer for an image forming apparatus.

According to the present invention, the molecular-weight distribution of the styrene-acrylic copolymer is limited to a predetermined range to assure good fixing properties at a low temperature and resistance to off-set, the content of styrene is increased to improve the fixing resin in heat resistance, and the component with a molecular weight exceeding $2.1\times10^5$ is contained to improve the toner in bending resistance. Thus, there may be obtained an electrophotographic toner excellent in fixing properties at a low temperature, resistance to off-set and heat resistance, as well as bending resistance.

EXAMPLES

The following description will discuss the present invention with reference to Examples thereof and Comparative Examples.

EXAMPLE 1

There were mixed (i) 100 parts by weight of a styrene (St)/butyl acrylate (BA) copolymer St:BA=85:15 (ratio by weight), 5% by weight of a component of which molecular weight exceeded $2.1\times10^5$] having the following molecular-weight distribution, (ii) 8 parts by weight of carbon black as the coloring agent, (iii) 1 part by weight of a negative-polarity dye as the charge controlling agent, and (iv) 1 part by weight of low molecular-weight polypropylene as the off-set preventing agent. After molten and kneaded, the resulting mixture was cooled, ground and classified to produce an electrophotographic toner having a volumetric median diameter of 12 μm. Molecular-Weight Distribution:

1) Molecular weight of the maximum value $P_H$: 205000
2) Molecular weight of the maximum value $P_L$: 5000

EXAMPLE 2

There was prepared an electrophotographic toner in the same manner as in Example 1, except for the use of 100 parts by weight of a styrene(St)/butyl acrylate (BA) copolymer St:BA =85:15 (ratio by weight), 12% by weight of a component of which molecular weight exceeded $2.1\times10^5$] having the following molecular-weight distribution, instead of 100 parts by weight of the copolymer used in Example 1. Molecular-Weight Distribution:

1) Molecular weight of the maximum value $P_H$ 210000
Molecular weight of the maximum value $P_L$: 5000

Comparative Example 1

There was prepared an electrophotographic toner in the same manner as in Example 1, except for the use of 100 parts by weight of a styrene(St)/butyl acrylate (BA) copolymer St:BA =85:15 (ratio by weight), 30% by weight of a component of which molecular weight $2.1\times10^5$] having the following molecular-exceeded weight distribution, instead of 100 parts by weight of the copolymer used in Example 1. Molecular-Weight Distribution:

1) Molecular weight of the maximum value $P_H$: 5000
2) Molecular weight of the maximum value $P_L$: 5000

Comparative Example 2

There was prepared an electrophotographic toner in the same manner as in Example 1, except for the use of 100 parts by weight of a styrene(St)/butyl acrylate (BA) copolymer St:BA =85:15 (ratio by weight), 0% by weight of a component of which molecular weight exceeded $2.1\times10^5$] having the following molecular-weight distribution, instead of 100 parts by weight of the copolymer used in Example 1. Molecular-Weight Distribution:

1) Molecular weight of the maximum value $P_H$: 190000
2) Molecular weight of the maximum value $P_L$: 5000

Comparative Example 3

There was prepared an electrophotographic toner in the same manner as in Example 1, except for the use of 100 parts by weight of a styrene(St)/butyl acrylate (BA) copolymer St:BA=70:30 (ratio by weight), 5% by weight of a component of which molecular weight exceeded $2.1\times10^5$] having the following molecular-weight distribution, instead of 100 parts by weight of the copolymer used in Example 1. Molecular-Weight Distribution:

1) Molecular weight of the maximum value $P_H$: 205000
2) Molecular weight of the maximum value $P_L$: 5000

Comparative Example 4

There was prepared an electrophotographic toner in the same manner as in Example 1, except for the use of 100 parts by weight of a styrene(St)/butyl acrylate (BA) copolymer St:BA =85:15 (ratio by weight), 0% by weight of a component of which molecular weight exceeded $2.1\times10^5$] having the following molecular-weight distribution, instead of 100 parts by weight of the copolymer used in Example 1. Molecular-Weight Distribution:

1) Molecular weight of the maximum value $P_H$: 80000
2) Molecular weight of the maximum value $P_L$: 5000

Comparative Example 5

There was prepared an electrophotographic toner in the same manner as in Example 1, except for the use of 100 parts by weight of a styrene(St)/butyl acrylate (BA) copolymer St:BA=85:15 (ratio by weight), 0% by weight of a component of which molecular weight exceeded $2.1\times10^5$] having the following molecular-weight distribution, instead of 100 parts by weight of the copolymer used in Example 1. Molecular-Weight Distribution:

1) Molecular weight of the maximum value $P_H$: 191000
2) Molecular weight of the maximum value $P_L$: 110000

Comparative Example 6

There was prepared an electrophotographic toner in the same manner as in Example 1, except for the use of 100 parts by weight of a styrene(St)/butyl acrylate (BA) copolymer St:BA =75:25 (ratio by weight), 5% by weight of a component of which molecular weight exceeded $2.1\times10^5$] having the following molecular-weight distribution, instead of 100 parts by weight of the copolymer used in Example 1. Molecular-Weight Distribution:

1) Molecular weight of the maximum value $P_H$: 205000
2) Molecular weight of the maximum value $P_L$: 5000

Comparative Example 7

There was prepared an electrophotographic toner in the same manner as in Example 1, except for the use of 100 parts by weight of a styrene(St)/butyl acrylate (BA) copolymer [St:BA =85:15 (ratio by weight), 25% by weight of a component of which molecular weight exceeded $2.1\times10^5$] having the following molecular-weight distribution, instead of 100 parts by weight of the copolymer used ole ple 1. Molecular-Weight Distribution:

1) Molecular weight of the maximum value $P_H$ 220000

2) Molecular weight of the maximum value $P_L$: 5000

0.2 Part by weight of hydrophobic silica was mixed with 100 parts by weight of each of the electrophotographic toners of Examples 1, 2 and Comparative Examples 1 to 7. A ferrite carrier having the average particle size of 80 μm was then blended with each of the resultant mixtures, and uniformly agitated and mixed to prepare a two-component developer having toner density of 4.0%. With the use of each of the developers thus prepared, the following tests were conducted.

Test of Fixing Properties

While the temperature set to the heating rollers of an electrophotographic copying apparatus (Modified Type of DC-2055 manufactured by Mita Industrial Co., Ltd.) (of the heating pressure roller fixing type) was raised in steps of 2.5° C. from 140° C., paper having thereon a toner image corresponding to a solid-black document was passed in the apparatus, causing the image to be fixed. An adhesive tape was pressingly contacted with each fixed image, and then separated therefrom. The density data of each fixed image before and after separation were measured with the reflection densitometer above-mentioned. According to the following equation, there was obtained the lowest temperature at which the fixing ratio exceeded 90%. The temperature thus obtained was defined as the lowest fixing temperature ($F_1$).

Fixing ratio (%) (Image density after separation/Image density before separation) $\times 100$ While the roller temperature was further raised, there was obtained the temperature at which off-set occurred. The temperature thus obtained was defined as a high-temperature off-set generating temperature ($F_2$).

Test of Resistance to Blocking

First, 20 g of each toner was put in a glass cylinder having an inner diameter of 26.5 mm in an oven with a predetermined temperature. A weight of 100 g was placed on the toner, which was then left for 30 minutes. Then, the cylinder was pulled out and the toner state was observed. There was recorded the oven temperature ($B_1$) at which each toner did not finally collapsed.

Observation of Toner Blanking

There was prepared a mesh chart in which 30 mesh patterns were being attached on the surface of white paper having a A4 size, each mesh pattern containing a plurality of parallel straight lines which were transversely and longitudinally drawn at regular intervals of about 0.57 mm in a regular square of which each side had a length of 24 mm. As a document, this mesh chart was copied with the copying apparatus above-mentioned using each of the developers above-mentioned. Five copied pieces were sampled at each of seven times, i.e., the starting, 500th, 1,000th, 2,000th, 3,000th, 4,000th and 5,000th times. All the extracted copies were checked for toner blanking and evaluated according to the following standards.

O: Presence of not greater than 9 blankings

X : Presence of not less than 10 blankings

Observation of "Rainfall"

A solid-black document was continuously copied for 20,000 pieces with the use of each of the developers above-mentioned. Each 20,000th copied piece was checked for "rainfall".

O: No "rainfall" observed

X : "Rainfall" observed

Measurement of Bending Properties

With an electrophotographic copying apparatus (DC-2055 manufactured by Mita Industrial Co., Ltd.) using each of the developers above-mentioned, a solid-black document was copied. Each copied piece was folded so that the image surface oppositely overlapped. Each folded piece was rubbed 10 times in a reciprocating manner while a load of about 200 g was exerted thereto. Then, each copied piece was unfolded and SILBON paper C was applied to the image at the folded portion, which was then rubbed 10 times in a reciprocating manner while a load of about 200 g was exerted. With a reflection densitometer (TC-6D manufactured by Tokyo Denshoku Co., Ltd.), there were measured the density data of each image at the folded portion before and after each piece was folded. Then, the density reduction ratio (%) of each image was obtained, based on which image separation was evaluated.

The results of the measurements and observations above-mentioned are shown in Tables 1 and 2.

TABLE 1

| | Bending Properties | $F_1$ °C. | $F_2$ °C. |
|---|---|---|---|
| Example 1 | 3.4 | 145 | 185 |
| Example 2 | 3.4 | 145 | 185 |
| Comparative Example 1 | 2.6 | 145 | 185 |
| Comparative Example 2 | 10.3 | 145 | 185 |
| Comparative Example 3 | 9.5 | 140 | 180 |
| Comparative Example 4 | 10.1 | 140 | 140 |
| Comparative Example 5 | 10.6 | 160 | 185 |
| Comparative Example 6 | 9.0 | 140 | 180 |
| Comparative Example 7 | 2.4 | 145 | 180 |

TABLE 2

| | $B_1$ °C. | Toner Blanking | "Rainfall" |
|---|---|---|---|
| Example 1 | 70 | ○ | ○ |
| Example 2 | 70 | ○ | ○ |
| Comparative Example 1 | 60 | X | X |
| Comparative Example 2 | 70 | ○ | ○ |
| Comparative Example 3 | 65 | ○ | ○ |
| Comparative Example 4 | 70 | X | X |
| Comparative Example 5 | 70 | ○ | ○ |
| Comparative Example 6 | 65 | ○ | ○ |
| Comparative Example 7 | 60 | X | X |

As apparent from Tables 1 and 2, it was found that, in each of Comparative Examples 2, 4, 5 each containing no component of which molecular weight exceeded $2.1 \times 10^5$ and Comparative Examples 3, 6 each containing styrene in an amount less than 80% by weight, the image after folded was considerably decreased in density so that each developer was liable to provoke image separation and therefore disadvantageous in bending resistance. It was also found that each of Comparative Examples 1, 7 each containing more than 20% by weight of the component of which molecular weight exceeded $2.1\times10^5$ and Comparative Examples 3, 6, was low in blocking temperature. It was also found that, in each of Comparative Examples 1, 7 and Comparative Example 4 in which the molecular weight of the maximum value $P_H$ was less than $1\times10^5$, toner blanking and "rainfall" due to blocking were observed. It was also found that Comparative Example 4 was low in high-temperature off-set temperature and therefore liable to produce off-set. It was also found that Comparative Example 5 in which the molecular weight of the maximum value $P_L$ exceeded $1\times10^5$, was high in lowest fixing temperature and therefore disadvantageous in low-temperature fixing properties. On the other hand, it was found each of Examples 1, 2 of the present invention was excellent in low-temperature fixing properties, resistance to offset and resistance to blocking, as well as bending resistance.

We claim:

1. An electrophotographic toner containing, as a fixing resin, a styrene-acrylic copolymer containing styrene in an amount of not less than 80% by weight with respect to the entire amount of said resin and presenting a gel permeation chromatogram of molecular-weight distribution in which the maximum value is located in each of ranges from not less than $2\times10^3$ to less than $1\times10^4$ and from not less than $1.5\times10^5$ to not greater than $2.5\times10^5$, and in which a component with a molecular weight exceeding $2.1\times10^5$ is contained in a range from 0.5 to 20% by weight with respect to the entire amount of said resin.

2. An electrophotographic toner according to claim 1, wherein the styrene-acrylic copolymer is a styrene-butyl acrylate copolymer.

3. The electrophotographic toner according to claim 1, wherein said styrene-acrylic copolymer comprises a styrene monomer selected from the group consisting of vinyl toluent, α-methylstyrene and styrene and an acrylic monomer having the formula

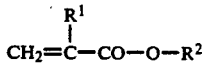

wherein $R^1$ is a hydrogen atom or a lower alkyl group and $R^2$ is a hydrogen atom, a hydrocarbon group having 1 to 12 carbon atom, a hydroxyalkyl group, a vinylester group, or an aminoalkyl group.

4. The electrophotographic toner according to claim 3, wherein said acrylic monomer is selected from the group consisting of acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl gamma-hydroxyacrylate, butyl δ-hydroxyacrylate, ethyl β-hydroxyacracrylate, propyl gammaamino-acrylate, propyl gamma-N,N-diethylaminoacrylate, ethylene glycol dimethacrylate, and tetraethylene glycol dimethacrylate.

* * * * *

UNITED STATES PATENT AND TRADEMARK OFFICE

CERTIFICATE OF CORRECTION

PATENT NO : 5,240,805

DATED : August 31, 1993

INVENTOR(S) : H. Asada et al.

It is certified that error appears in the above-identified patent and that said Letters Patent is hereby corrected as shown below:

In Claim 1, at col. 12, line 1, change "0.5" to --5--.

Signed and Sealed this

Ninth Day of March, 1999

*Attest:*

Q. TODD DICKINSON

*Attesting Officer*

*Acting Commissioner of Patents and Trademarks*